US006873292B2

(12) United States Patent
Yoo et al.

(10) Patent No.: US 6,873,292 B2
(45) Date of Patent: Mar. 29, 2005

(54) SURFACE MOUNTED TYPE CHIP ANTENNA FOR IMPROVING SIGNAL INTERFIX AND MOBILE COMMUNICATION APPARATUS USING THE SAME

(75) Inventors: Seung Jong Yoo, Seoul (KR); Jae Suk Sung, Suwon (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 10/328,046

(22) Filed: Dec. 26, 2002

(65) Prior Publication Data

US 2003/0218573 A1 Nov. 27, 2003

(30) Foreign Application Priority Data

May 21, 2002 (KR) ..... 2002-28141

(51) Int. Cl.[7] ..... H01Q 1/24; H01Q 1/38
(52) U.S. Cl. ..... 343/702; 343/700 MS
(58) Field of Search ..... 343/702, 700 MS, 343/846, 848; H01Q 1/24, 1/38

(56) References Cited

U.S. PATENT DOCUMENTS 6,542,124 B1 * 4/2003 Yoon ..... 343/700 MS
6,683,573 B2 * 1/2004 Park ..... 343/700 MS
2003/0058173 A1 * 3/2003 Yoon ..... 343/702

FOREIGN PATENT DOCUMENTS

JP 11-239018 * 8/1999 ..... H01Q/13/08

OTHER PUBLICATIONS

Patent Abstracts of Japan–Publication No. 2000–138515, Published May 16, 2000.
Patent Abstracts of Japan–Publication No. 09–223915, Published Aug. 26, 1997.
Patent Abstracts of Japan–Publication No. 10–200327, Published Jul. 31, 1998.
Patent Abstracts of Japan–Publication No. 2000–151258, Published May 30, 2000.
Patent Abstracts of Japan–Publication No. 02–220505, Published Sep. 3, 1990.
Patent Abstracts of Japan–Publication No. 10–229304, Published Aug. 25, 1998.
Patent Abstracts of Japan–Publication No. 09–098009, Published Apr. 8, 1997.
Patent Abstracts of Japan–Publication No. 2000–216621, Published Aug. 4, 2000.
Patent Abstracts of Japan–Publication No. 2001–007639, Published Jan. 12, 2001.

* cited by examiner

*Primary Examiner*—Don Wong
*Assistant Examiner*—Trinh Vo Dinh
(74) *Attorney, Agent, or Firm*—Lowe Hauptman & Berner, LLP

(57) ABSTRACT

A surface mounted type chip antenna comprises: a body including an upper surface, a lower surface, and four side surfaces; a feeding pad formed on the lower surface and the first side surface of the body; a radiation electrode formed on the upper surface of the body and electrically connected to the feeding pad; a short bar formed on the third side surface being opposite to the first side surface and connected to the radiation electrode; and a ground electrode formed on the lower surface of the body, spaced apart from the feeding pad, and connected to the short bar. When the antenna is installed in a mobile communication apparatus, a location where a maximum current is generated is remote from circuitry of the PCB of the mobile apparatus.

19 Claims, 7 Drawing Sheets

SURFACE MOUNTED TYPE CHIP ANTENNA FOR IMPROVING SIGNAL INTERFIX AND MOBILE COMMUNICATION APPARATUS USING THE SAME

BACKGROUND OF THE INVENTION

1. Field of the Invention

The present invention relates to a surface mounted type chip antenna for improving signal interfix, and a mobile communication apparatus using the antenna.

2. Description of the Related Art

Recently, development trends of mobile communication terminals have been directed toward miniaturization, light-weight, and multi-functionality. In order to satisfy this trend, circuits and parts, which are installed on the mobile communication terminals, have been miniaturized and made multi-functional. Therefore, antennas of the mobile communication terminals have also been miniaturized and made multi-functional.

Generally, antennas which is used in the mobile communication terminals are divided into two types, i.e., a helical antenna and a planar inverted F-type antenna (referred to as a "PIFA"). The helical antenna is an external antenna, which is fixed to the upper surface of the terminal. The helical antenna is mostly used in combination with a monopole antenna. This combined structure of the helical antenna and the monopole antenna has a length of $\lambda/4$. Herein, the monopole antenna is an internal antenna, which is stored within the terminal. The monopole antenna is pulled out, thereby being used as the antenna of the terminal in combination with the external helical antenna.

The combined structure of the helical antenna and the monopole has high gain. However, this combined structure of the helical antenna and the monopole antenna has a low SAR characteristic due to the non-directivity. Herein, the SAR(Specific Absorption Rate) characteristic is an index of harmfulness of an electromagnetic wave to the human body. It is difficult to aesthetically and portably design the appearance of the helical antenna. Further, the monopole antenna requires a storage space within the terminal. Therefore, the combined structure of the helical antenna and the monopole antenna limits the miniaturization of the mobile communication product using this structure. In order to solve these problems, a chip antenna having a low profile structure has been introduced.

FIG. 1 is a schematic view illustrating a principle of operation of a conventional chip antenna. The chip antenna of FIG. 1 is referred to as the planar inverted F-type antenna (PIFA). The name of the chip antenna is due to its shape. As shown in FIG. 1, the chip antenna comprises a radiation patch (RE), a short-circuit pin (GT), a coaxial line (CL), and a ground plate (GND). Herein, power is supplied to the radiation patch (RE) through the coaxial line (CL). The radiation patch (RE) is connected to the ground plate (GND) through the short-circuit pin (GT), thereby performing the impedance matching. It is to be noted that the chip antenna is designed so that the length (L) of the radiation patch (RE) and the height (H) of the antenna are determined by the width (Wp) of the short-circuit pin (GT) and the width (W) of the radiation patch (RE).

In this chip antenna, among beams generated by the induced current to the radiation patch (RE), beams directed toward the ground plate are re-induced, thereby reducing the beams directed toward the human body and improving the SAR characteristic. Further, the beams induced toward the radiation patch (RE) are improved. A microstrip antenna in a square shape, in which the radiation patch is reduced to half that of the aforementioned chip antenna, achieves a lower profile structure, thereby being currently spotlighted. Further, in order to satisfy the trend of multi-functionality, the chip antenna has been variously modified, thereby being particularly developed as a dual band chip antenna, which is usable at multiple frequency bands.

FIG. 2*a* is a perspective view of a conventional dual band chip antenna, and FIG. 2*b* is a schematic view of a configuration of a mobile communication apparatus using the conventional dual band chip antenna.

With reference to FIG. 2*a*, the conventional dual band chip antenna 10 comprises a radiation patch 12 formed in a planar square shape, a short-circuit pin 14 for grounding the radiation patch 12, a power-feeding pin 15 for feeding power to the radiation patch 12, and a dielectric block 11 provided with a ground plate 19. In order to achieve dual band function, an U-type slot may be formed on the radiation patch 12. Herein, the radiation patch 12 is substantially divided into two areas by the slot, thereby inducing the current flowing along the slot to have different lengths so as to resonate in two different frequency bands. Therefore, the dual band chip antenna 10 is operated in two different frequency bands, for example, GSM band and DCS band.

However, recently, the usable frequency band has been variously diversified, i.e., CDMA (Code Division Multiple Access) band (approximately 824~894 MHz), GPS (Global Positioning System) band (approximately 1,570~1,580 MHz), PCS (Personal Communication System) band (approximately 1,750~1,870 MHZ or 1,850~1,990 MHZ), and BT (Blue Tooth) band (approximately 2,400~2,480 MHz), thereby requiring a multiple band characteristic more than the dual band characteristic. Therefore, the system using the aforementioned slot is limited in designing the antenna with the multiple band characteristic. Further, since the conventional antenna has a low profile so as to be mounted on the mobile communication terminal, the usable frequency band is narrow. Particularly, the height of the antenna is restricted by the limited width of the terminal of the mobile communication apparatus, thereby further increasing the problem of the narrow frequency band.

The dual band chip antenna 10 of FIG. 2*a* comprises one feeding port formed on the power-feeding pin 15. Therefore, in case that this dual band chip antenna is installed on a mobile communication apparatus, such as a dual band phone, as shown in FIG. 2*b*, the mobile communication apparatus requires a band splitting unit 21 for splitting the frequency band from the chip antenna 10 into GPS band and CDMA band. For example, the band splitting unit 21 is a diplexer or a switch. Therefore, it is difficult to miniaturize the mobile communication apparatus using the dual band chip antenna.

In order to solve the problem of the narrow frequency bandwidth, a distribution circuit such as a chip-type LC device is additionally connected to the antenna, thereby controlling the impedance matching and achieving a somewhat wide frequency band. However, this method, in which the external circuit is involved in the frequency modulation, causes another problem, such as the deterioration of the antenna efficiency.

FIG. 3 is a perspective view of another conventional chip antenna. With reference to FIG. 3, the chip antenna 10 comprises a body 2 having a hexahedral shape, which is made of dielectric material or magnetic material, a ground electrode 3 formed on one whole surface of the body 2, a radiation electrode 4 formed on at least another whole surface of the body 2, and a power-feeding electrode 5 formed on yet another surface of the body 2. One end 4*a* of the radiation electrode 4 is opened and is formed adjacent to the power-feeding electrode 5. The one end 4*a* of the radiation electrode 4 is spaced apart from the power-feeding electrode 5 by a gap 6. The other end of the radiation electrode 4 is branched into multiple sections, thereby forming ground terminals 4*b* and 4*c*. The ground terminals 4*b* and 4*c* are connected to the ground electrode 3 via different surfaces of the body 2. Japanese Laid-open Publication No. 11-239018 discloses the configuration of this chip antenna in detail.

In the aforementioned chip antenna, compared to other area of the radiation electrode, a short bar for connecting the ground electrode to radiation electrode is very narrow. Therefore, a conduction loss of the radiation electrode is increased at the short bar, thereby deteriorating antenna efficiency. Herein, arrows J1 and J2 indicate a direction of flow of current on the radiation electrode.

FIG. 4 is a plan view of the printed circuit board (PCB) of FIG. 3, showing an antenna portion for mounting an antenna and a generation location of maximum current. That is, FIG. 4 shows the antenna portion for mounting the antenna and the generation location of maximum current, in case the conventional chip antenna is installed on the printed circuit board (PCB) of a mobile communication apparatus. The conventional antenna as shown in FIG. 1 is a short bar type patch antenna, which uses an electromagnetic coupling (EMC) feeding method, and comprises two short bars. Either of two short bars corresponds to the feeding pad. Therefore, when this antenna shown in FIG. 3 is installed on the printed circuit board (PCB) of the mobile communication apparatus, as shown in FIG. 4, the generation location of maximum current (MC) is adjacent to other circuits such as a radio frequency (RF) circuit on the printed circuit board (PCB).

Therefore, in the above-described chip antenna shown in FIG. 3, one short bar is coplanar to the feeding pad, thereby forming a non-linear current path. Thus, the conventional chip antenna improves a cross polarization level, but reduces a co-polarization level, thereby reducing a gain. Further, the conventional chip antenna generates interface with the radio frequency (RF) circuit of the printed circuit board (PCB).

SUMMARY OF THE INVENTION

Therefore, the present invention has been made in view of the above problems, and it is an object of the present invention to provide a surface mounted type chip antenna in which a current path is linearly formed by forming a feeding pad and a short bar to be opposed to each other, thereby improving a gain of the antenna, and a mobile communication apparatus using the surface mounted type chip antenna.

It is another object of the present invention to provide a surface mounted type chip antenna which reduces interference with other circuits of a printed circuit board (PCB) of a mobile communication apparatus by arranging a location of generating maximum current to be remote from other circuits of the printed circuit board (PCB) when the surface mounted type chip antenna is installed on the mobile communication apparatus, and a mobile communication apparatus using the surface mounted type chip antenna herein.

In accordance with one aspect of the present invention, the above and other objects can be accomplished by providing a surface mounted type chip antenna mounted on a surface of a printed circuit board having a circuit portion, said antenna comprising: a body including an upper surface, a lower surface, and four side surfaces; a conductive feeding pad formed on the lower surface and the first side surface of the body; a conductive radiation electrode formed on the upper surface of the body and electrically connected to the feeding pad; a short bar formed on the third side surface being opposite to the first side surface and connected to the radiation electrode; and a ground electrode formed on the lower surface of the body, spaced apart from the feeding pad, and connected to the short bar.

In accordance with another aspect of the present invention, there is provided a mobile communication apparatus using a surface mounted type chip herein. The mobile communication apparatus comprises a printed circuit board (PCB) and a surface mounted type chip antenna. The printed circuit board (PCB) comprises: a circuit portion (CP) including circuits such as a radio frequency (RF) circuit; and an antenna portion (AP) for mounting the chip antenna, the antenna portion (AP) being connected to the circuit portion (CP) and surface mounted type chip antenna. Herein, a linear flow of current is generated by the feeding pad and the short bar, in which the feeding pad is formed on the first side surface at a designated area adjacent to the fourth side surface being opposite to the second side surface neighboring the circuit portion (CP) of the printed circuit board (PCB), and the short bar is formed on the third side surface at a designated area adjacent to the fourth side surface being opposite to the second side surface neighboring the circuit portion (CP) of the printed circuit board (PCB).

BRIEF DESCRIPTION OF THE DRAWINGS

The above and other objects, features and other advantages of the present invention will be more clearly understood from the following detailed description taken in conjunction with the accompanying drawings, in which:

FIG. 5*c* is ,a view similar to FIG. 5*a*, showing an alternative embodiment of the present invention;

DESCRIPTION OF THE PREFERRED EMBODIMENTS

Hereinafter, preferred embodiments of the present invention will be described in detail with reference to the accompanying drawings.

Figure 1:
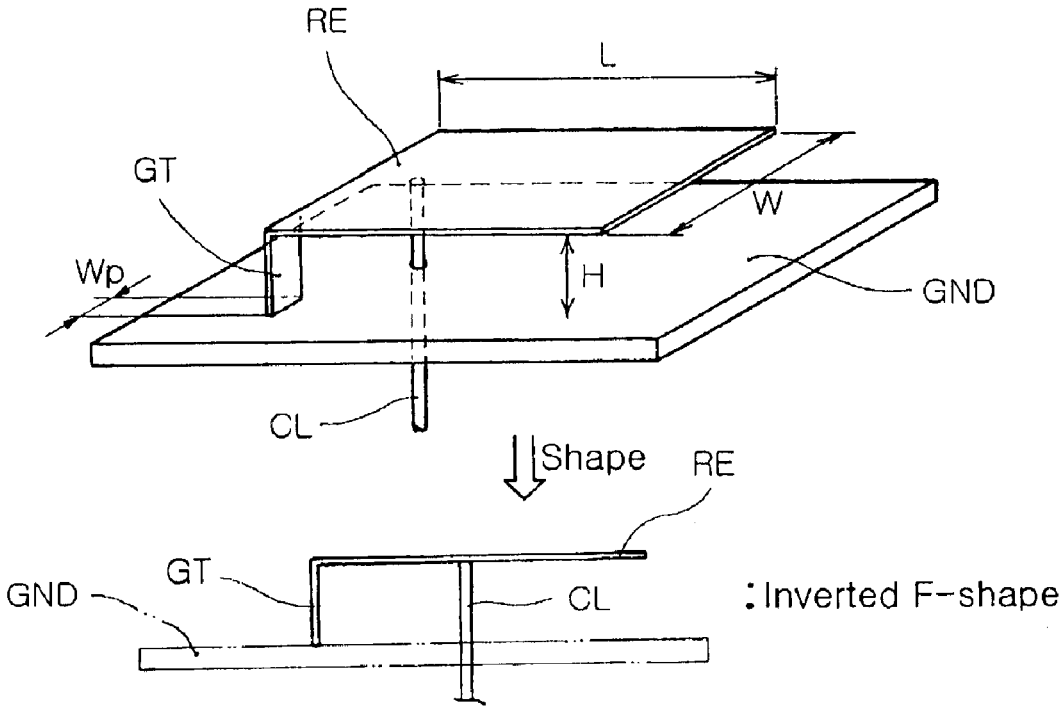
Prior Art FIG. 1
FIG. 1 is a schematic view illustrating a principle of operation of a conventional chip antenna.
Figure 2A:
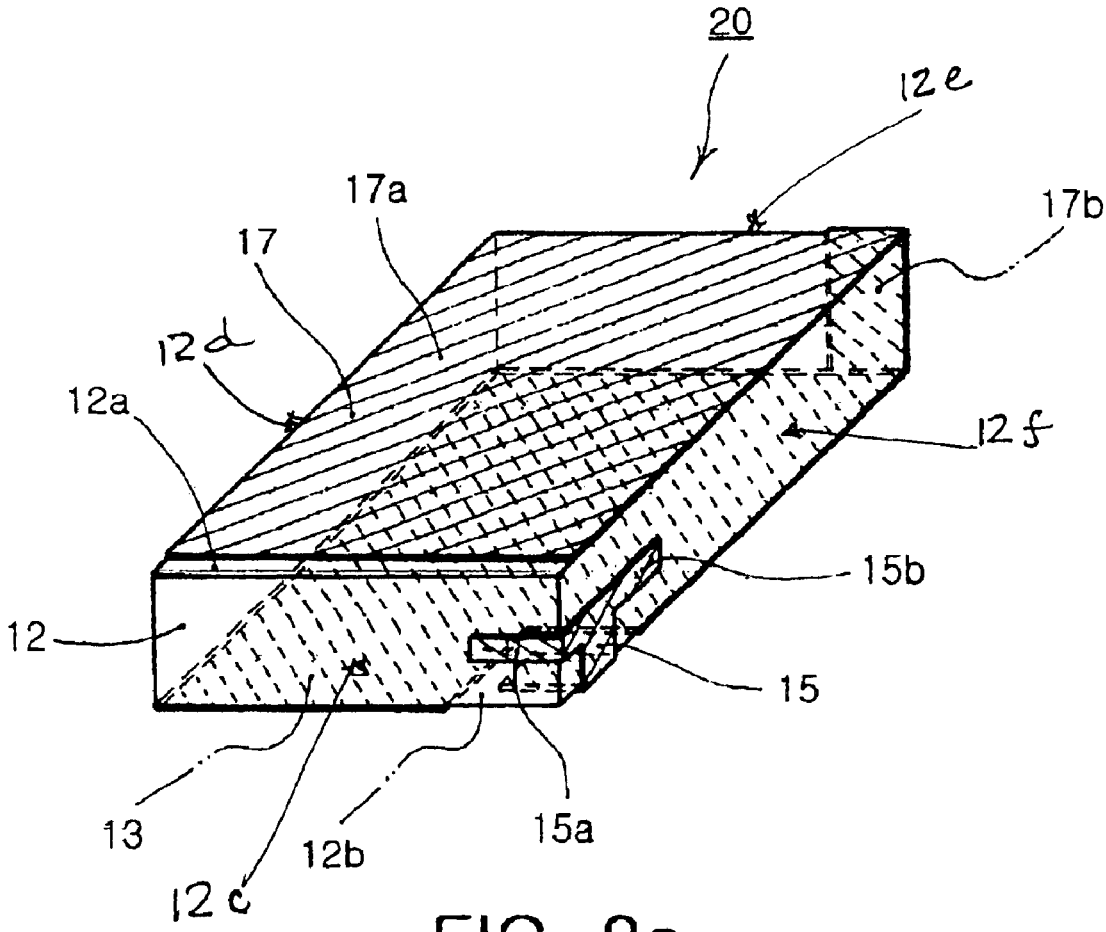
FIG. 2*a* is a perspective view of a conventional dual band chip antenna.
Figure 2B:
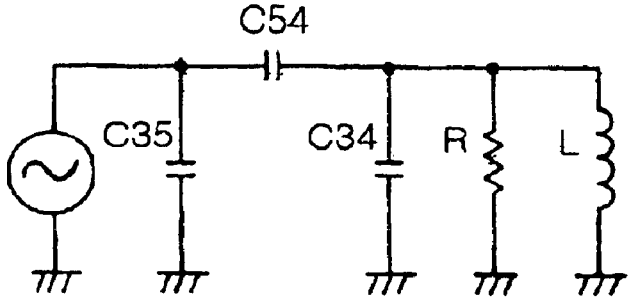
FIG. 2*b* is a schematic view of a configuration of a mobile communication apparatus using the conventional dual band chip antenna.
Figure 3:
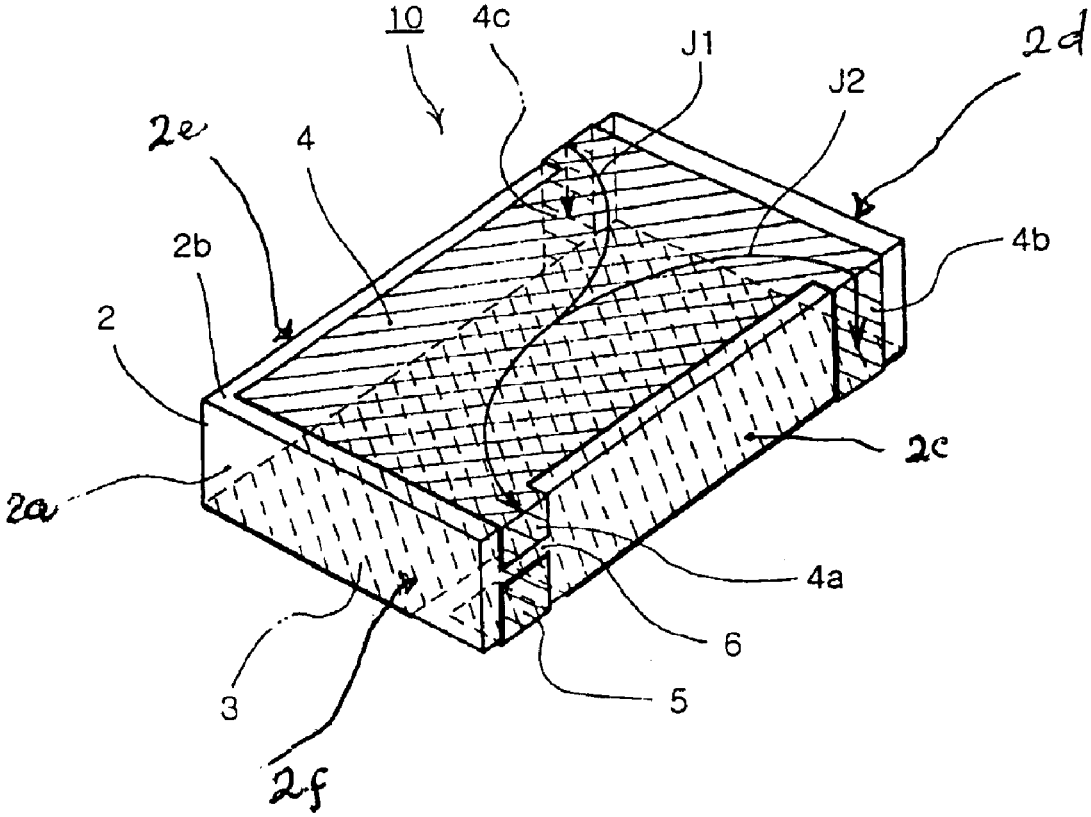
Prior Art FIG. 3
FIG. 3 is a perspective view of another conventional chip antenna.
Figure 4:
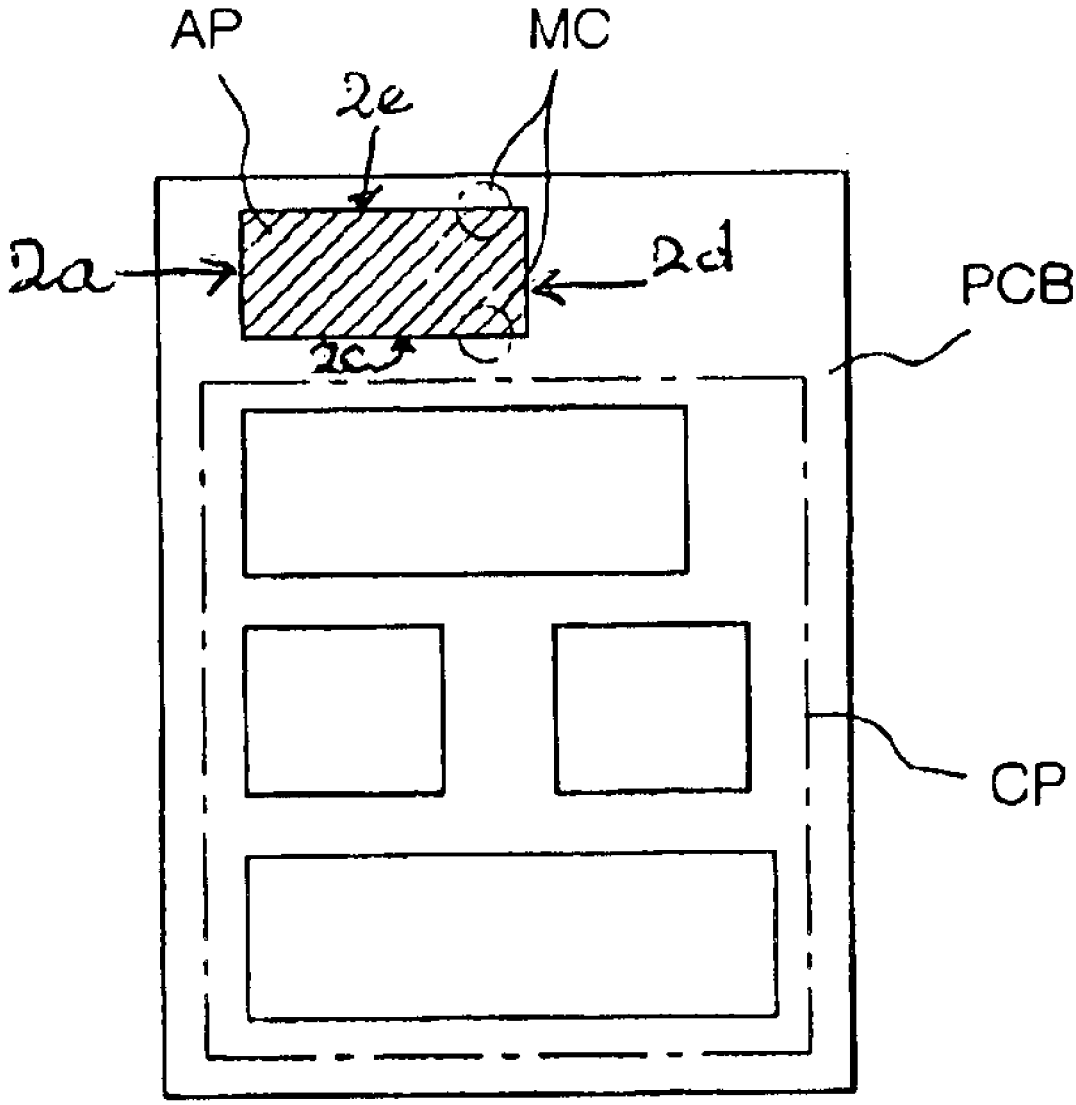
Prior Art FIG. 4
FIG. 4 is a plan view of a printed circuit board (PCB) showing an antenna portion for mounting an antenna and a generation location of a maximum current.
Figure 5A:
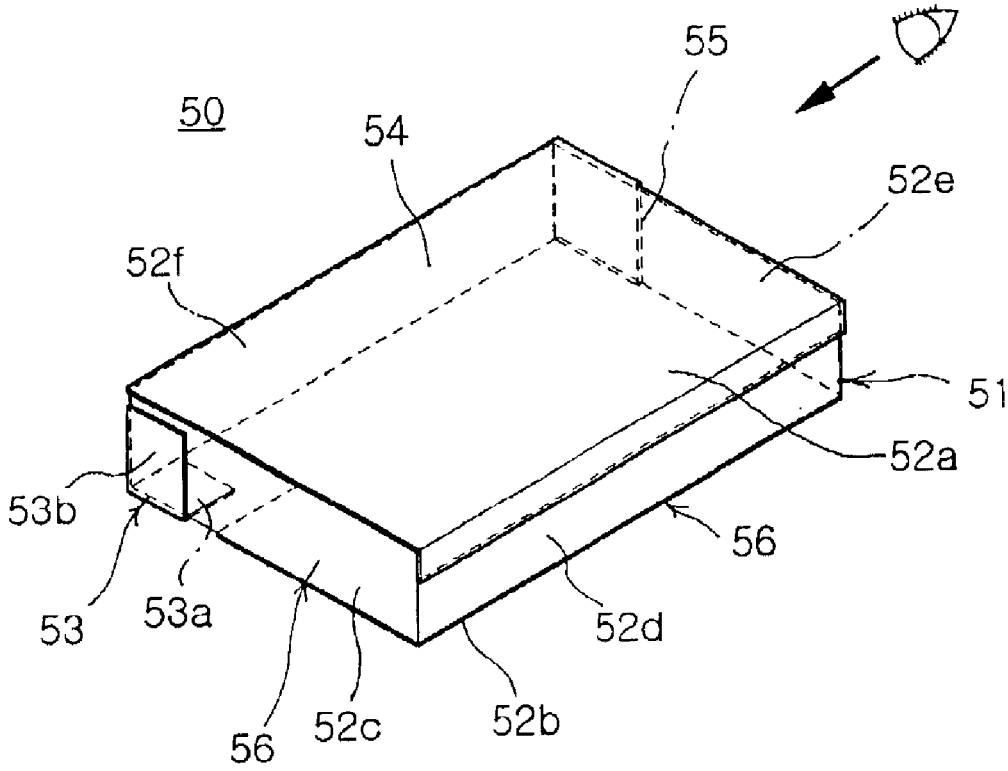
FIGS. 5*a* and 5*b* are a perspective view of a surface mounted type chip antenna and a side view of a surface mounted type chip antenna shown in arrow direction in accordance with a first embodiment of the present invention.
Figure 5B:
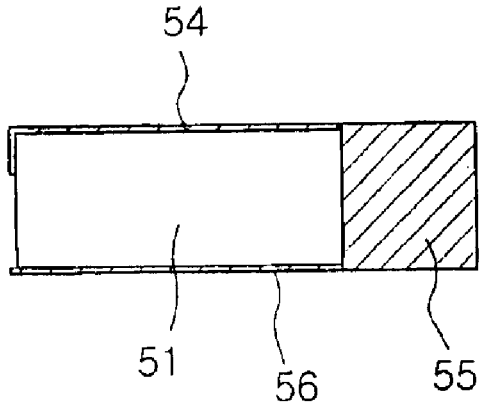

FIGS. 5*a* and 5*b* respectively represents a perspective view of a surface mounted type chip antenna and a side view of a surface mounted type chip antenna shown in arrow in accordance with a first embodiment of the present invention. With reference to FIGS. 5*a* and 5*b*, the surface mounted type chip antenna 50 of the first embodiment of the present invention is mounted on a surface of a printed circuit board having a circuit portion. The antenna comprises a body 51, a feeding pad 53, a conductive radiation electrode 54, a short bar 55, and a ground electrode 56. The body 51 includes an upper surface 52*a*, a lower surface 52*b*, and four side surfaces 52*c*, 52*d*, 52*e*, and 52*f*. The feeding pad 53 is formed on the lower surface 52*b* and the first side surface 52*c* of the body 51. The radiation electrode 54 is formed on the upper surface 52*a* of the body 51 and electrically connected to the feeding pad 53. The short bar 55 is formed on the third side surface 52*e* being opposite to the first side surface 52*c* and connected to the radiation electrode 54. The ground electrode 56 is formed on the lower surface 56*b*, spaced apart from the feeding pad 53, and connected to the short bar 55.

The body 51 may be made of dielectric or magnetic material. As shown in FIG. 5*a*, the body 51 may be shaped in a hexahedral shape having the upper surface 52*a*, the lower surface 52*b*, and four side surfaces 52*c*, 52*d*, 52*e*, and 52*f*, but is not limited thereto.

The radiation electrode 54 is formed on the upper surface 52*a* of the body 51. The radiation electrode 54 may be spaced apart from the feeding pad 53 with a designated distance, as shown in Alternatively, the radiation electrode 54 may be directly connected to the feeding pad 53, as shown in FIG. 5*c*. In case the radiation electrode 54 is spaced apart from the feeding pad 53 with a designated distance, the radiation electrode 54 is electromagnetically coupled with the feeding pad 53.

The first side surface 52*c*, on which the feeding pad 53 is formed, is neighbored the second side surface 52*d* which is mostly adjacent to circuits of a printed circuit board (PCB). The conductive feeding pad 53 comprises a feeding port 53*a* and a feeding line 53*b*. The feeding port 53*a* is formed on the lower surface 52*b* of the body 51. The feeding line 53*b* is formed on the first side surface 52*c* of the body 51 and connected to the feeding port 53*a*.

In this embodiment of the present invention, in order to remove signal interference with the circuits of the PCB by maximum current, the feeding line 53*b* is preferably formed on the first side surface 52*c* adjacent to the fourth side surface 52*f* being opposite to the second side surface 52*d*, and the short bar 55 is preferably formed on the third side surface 52*e* adjacent to the fourth side surface 52*f* being opposite to the second side surface 52*d* of the body 51.

Further, preferably, the feeding pad and short bar together are on the axis which run parallel on length direction of fourth side. More preferably, the feeding line 53*b* on the first side surface 52*c* and the short bar 55 on the third side surface 52*e* are formed adjacent to the fourth side surface 52*f* being opposite to the second side surface 52*d* of the body 51.

Figure 6A:
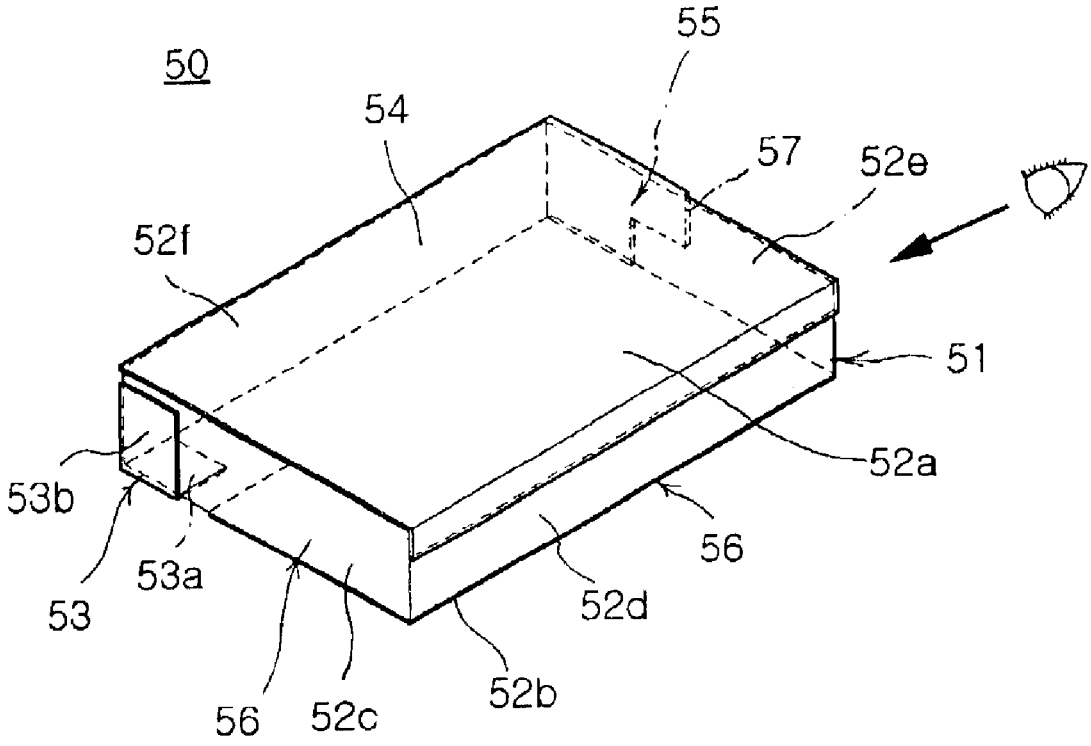
FIGS. 6*a* and 6*b* are a perspective view of a surface mounted type chip antenna and a side view of a surface mounted type chip antenna shown in arrow direction in accordance with an improvement of the first embodiment of the present invention.
Figure 6B:
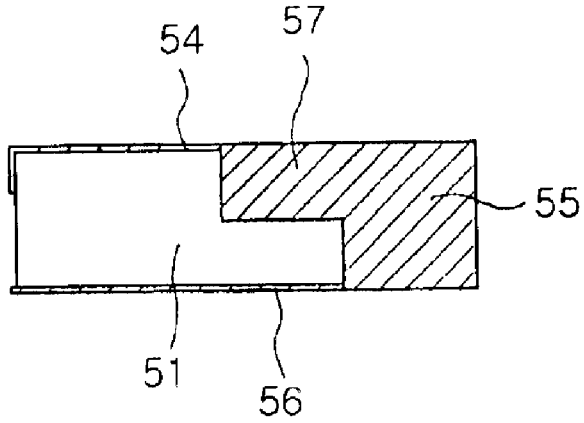

FIGS. 6*a* and 6*b* represents a perspective view of a surface mounted type chip antenna and a side view of a surface mounted type chip antenna shown in arrow direction in accordance with an improvement of the first embodiment of the present invention. With reference to FIGS. 6*a* and 6*b*, the surface mounted type chip antenna 50 further comprises a conductive impedance controller 57 connected to the short bar 55. The impedance controller 57 serves to trim frequency to a desired level after manufacturing the chip antenna 50. The impedance controller 57 may be formed on a designated region of the third side surface 52*e* of the body 51. Alternatively, the impedance controller 57 may be extended to a designated region of the fourth side surface 52*f* of the body 51.

As described above, the present invention provides the impedance controller 57 functioning as a means for adjusting impedance so as to trim frequency when frequency adjustment is required after manufacturing the chip antenna. Thereby, impedance can be adjusted by altering conductive regions of the impedance controller 57, thereby controlling frequency.

On the other hand, some conventional chip antennas remove partially the radiation patch or remove partially the feeding line in order to trim frequency. These methods can control frequency, but have a disadvantage of deteriorating radiation efficiency.

However, in accordance with the present invention, frequency can be controlled without the deterioration of the radiation efficiency. Those skilled in the art will appreciate that the aforementioned impedance controller is applied to other embodiments as well as the first embodiment of the present invention.

Figure 7A:
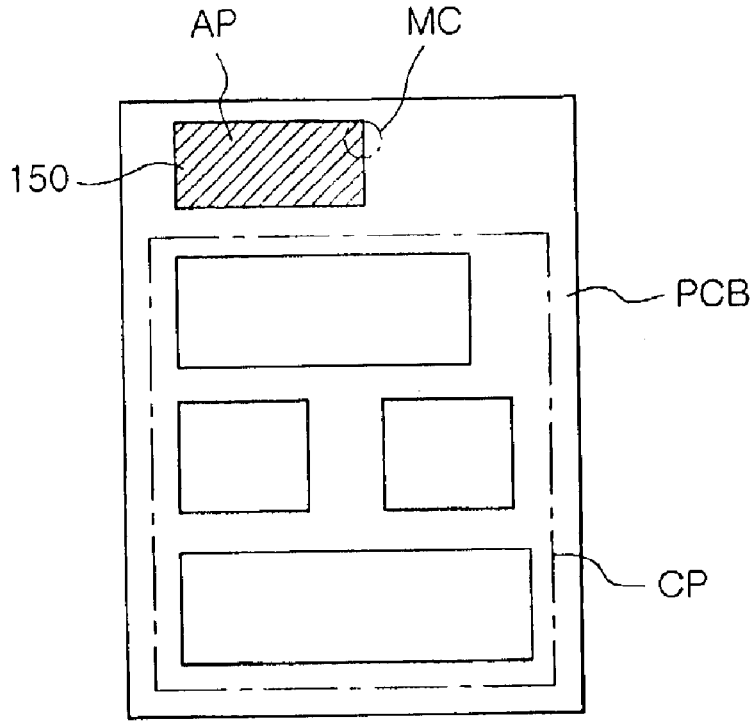
FIGS. 7*a* and 7*b* are a plan view of a printed circuit board (PCB) of a mobile communication apparatus using a chip antenna and a perspective view of a surface mounted type chip antenna in accordance with a second embodiment of the present invention.
Figure 7B:
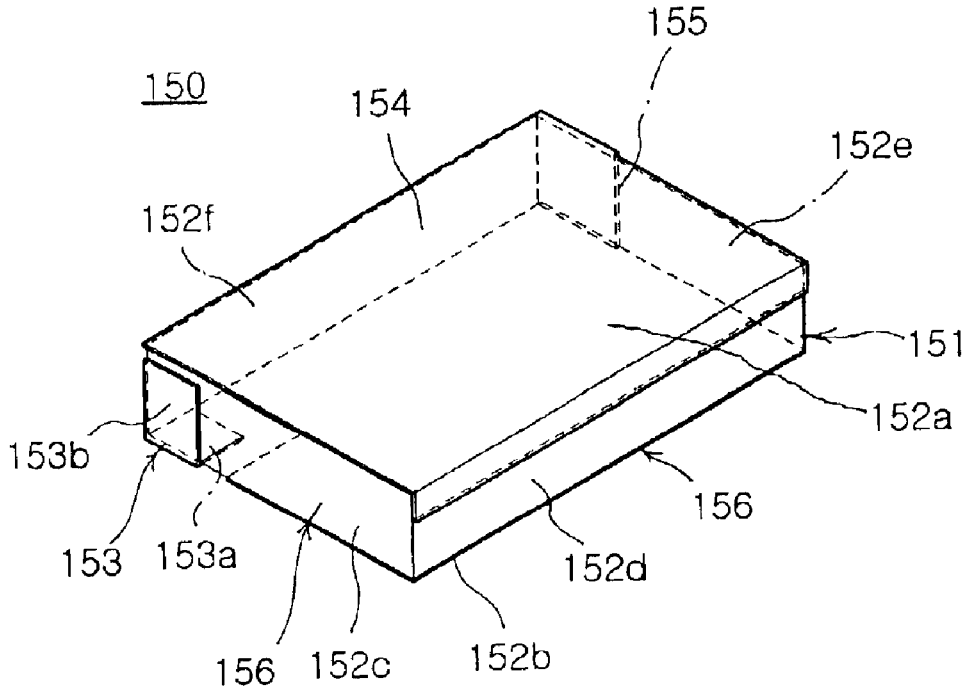

FIGS. 7*a* and 7*b* are a plan view of a printed circuit board (PCB) of a mobile communication apparatus using a chip antenna and a perspective view of a surface mounted type chip antenna in accordance with a second embodiment of the present invention. With reference to FIG. 7*a*, the mobile communication apparatus using the chip antenna which is mounted on a surface of a printed circuit board having a circuit portion in accordance with the second embodiment of the present invention, comprises the printed circuit board (PCB) and the chip antenna 150.

The printed circuit board (PCB) comprises a circuit portion (CP) including circuits such as a radio frequency (RF) circuit, and an antenna portion (AP) for mounting the chip antenna 150. The antenna portion (AP) is connected to the circuit portion (CP). As shown in FIG. 7*b*, the surface mounted type chip antenna 150 comprises the body 151 which includes an upper surface 152*a*, a lower surface 152*b*, and four side surfaces 152*c*, 152*d*, 152*e*, and 152*f*, the feeding pad 153 which is formed on the lower surface 152*b* and the first side surface 152*c* of the body 151, the conductive radiation electrode 154 which is formed on the upper surface 152*a* of the body 151 and electrically connected to the feeding pad 153, the short bar 155 which is formed on the third side surface 152*e* being opposite to the first side surface 152*c* and connected to the radiation electrode 154, and the ground electrode 156 which is formed on the lower surface 156*b*, spaced apart from the feeding pad 153, and connected to the short bar 155.

Herein, as described above, the radiation electrode 154 is formed on the upper surface 152*a* of the body 151. The radiation electrode 154 may be spaced apart from the feeding pad 153 with a designated distance. Otherwise, the radiation electrode 154 directly connected to the feeding pad 153. In case the radiation electrode 154 is spaced apart from the feeding pad 153 with a designated distance, the radiation electrode 154 is electromagnetically coupled with the feeding pad 53.

Further, a linear flow of current is generated by the feeding pad 153 and the short bar 155. The feeding pad 153 is formed on the first side surface 152*c* adjacent to the fourth side surface 152*f* being opposite to the second side surface 152*d* of the body 151. That is, the feeding pad 153 is remote from the circuit portion (CP) of the printed circuit board (PCB). The short bar 155 is formed on the third side surface 152*e* adjacent to the fourth side surface 152*f* being opposite to the second side surface 152*d* of the body 151. That is, the short bar 155 is also remote from the circuit portion (CP) of the printed circuit board (PCB).

As described above, when the chip antenna of the present invention is mounted on the printed circuit board (PCB) of the mobile communication apparatus, the antenna portion (AP) for mounting the chip antenna and the circuit portion (CP) including the circuits such as the radio frequency (RF) circuit are located on a single printed circuit board (PCB). Herein, the antenna portion (AP) is adjacent to the circuit portion (CP) at a designated region of the printed circuit board (PCB).

Current flowing between the feeding pad and the short bar of the chip antenna of the present invention is accumulated on the small-sized short bar, thereby generating maximum current at the short bar. When the surface mounted type chip antenna of the present invention is installed on a printed circuit board (PCB) of a mobile communication apparatus, the feeding port and the short bar of the chip antenna are remote from the circuit portion (CP) of the printed circuit board (PCB). Therefore, maximum current generated at the feeding port and the short bar have less effect on the circuit portion (CP) of the printed circuit board (PCB), thereby minimizing signal interference of the maximum current of the feeding port and the short bar with the circuit portion (CP) of the printed circuit board (PCB).

Further, in this embodiment of the present invention, the feeding pad 153 is opposite to the short bar 155, thereby forming a short and straight path for transmitting signal and enabling a linear flow of current. Therefore, a co-polarization level of the surface mounted type chip antenna is improved, and a gain of the surface mounted type chip antenna is also improved.

As apparent from the above description, in accordance with the present invention, the feeding pad of the surface mounted type chip antenna is opposite to the short bar, thereby forming the linear current path. Further, when the surface mounted type chip antenna of the present invention is installed on the mobile communication apparatus, a location for generating maximum current is remote from other circuits of the printed circuit board (PCB) of the mobile communication apparatus, thereby improving the gain of the chip antenna and reducing interference with other circuits of the printed circuit board (PCB) of the mobile communication apparatus.

That is, in accordance with the present invention, the interference of the chip antenna with circuits of the printed circuit board (PCB) can be reduced by altering the positions of the feeding pad and the short bar. Further, compared to the conventional chip antenna, the surface mounted type chip antenna of the present invention can obtain an excellent gain.

Furthermore, after manufacturing the surface mounted type chip antenna of the present invention, the chip antenna can control impedance or frequency without the deterioration of radiation characteristics.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A surface mounted type chip antenna to be mounted on a surface of a printed circuit board having a circuit portion, said antenna comprising:

a body including an upper surface, a lower surface, and first, second, third, and fourth side surfaces;

a conductive feeding pad having a feeding port formed on the lower surface of the body and a feeding line formed on the first side surface of the body and directly connected to the feeding port;

a conductive radiation electrode formed on the upper surface of the body and electrically connected to the feeding pad;

a short bar formed on the third side surface being opposite to the first side surface and connected to the radiation electrode; and a ground electrode formed on the lower surface of the body, spaced apart from the feeding pad, and connected to the short bar;

wherein said short bar is formed on the third side surface at a designated area adjacent to the fourth side surface being opposite to the second side surface of the body.

2. The surface mounted type chip antenna as set forth in claim 1, wherein the radiation electrode is formed on the upper surface of the body and spaced apart from the feeding pad with a designated distance.

3. The surface mounted type chip antenna as set forth in claim 1, wherein the feeding port meets the feeding line at a boundary between the first side surface and the lower surface.

4. A surface mounted type chip antenna to be mounted on a surface of a printed circuit board having a circuit portion, said antenna comprising:

a body including an upper surface, a lower surface, and first, second, third, and fourth side surfaces;

a conductive feeding pad formed on the lower surface and the first side surface of the body;

a conductive radiation electrode formed on the upper surface of the body and electrically connected to the feeding pad;

a short bar formed on the third side surface being opposite to the first side surface and connected to the radiation electrode; and a ground electrode formed on the lower surface of the body, spaced apart from the feeding pad, and connected to the short bar;

wherein said radiation electrode is formed on the upper surface of the body and directly connected to the feeding pad.

5. A surface mounted type chip antenna to be mounted on a surface of a printed circuit board having a circuit portion, said antenna comprising:

a body including an upper surface, a lower surface, and first, second, third, and fourth side surface;

a conductive feeding pad formed on the lower surface and the first side surface of the body;

a conductive radiation electrode formed on the upper surface of the body and electrically connected to the feeding pad;

a short bar formed on the third side surface being opposite to the first side surface and connected to the radiation electrode; and a around electrode formed on the lower surface of the body, spaced apart from the feeding pad, and connected to the short bar;

wherein said short bar is formed on the third side surface at a designated area adjacent to the fourth side surface being opposite to the second side surface of the body; and said first side surface of the body provided with the feeding pad is neighbored to the second side surface adjacent to the circuit portion of the printed circuit board (PCB).

6. The surface mounted type chip antenna as set forth in claim 5, wherein said feeding pad comprises:

a feeding port formed on the lower surface of the body; and a feeding line formed on the first side surface of the body and connected to the feeding port.

7. The surface mounted type chip antenna as set forth in claim 6, wherein said feeding line of the feeding pad is opposite to the short bar.

8. The surface mounted type chip antenna as set forth in claim 6, wherein said feeding line is formed on the first side surface at a designated area adjacent to the fourth side surface being opposite to the second side surface of the body.

9. A surface mounted type chip antenna to be mounted on a surface of a printed circuit board having a circuit portion, said antenna comprising:

a body including an upper surface, a lower surface, and first, second, third, and fourth side surfaces;

a conductive feeding pad formed on the lower surface and the first side surface of the body;

a conductive radiation electrode formed on the upper surface of the body and electrically connected to the feeding pad;

a short bar formed on the third side surface being opposite to the first side surface and connected to the radiation electrode;

a ground electrode formed on the lower surface of the body, spaced apart from the feeding pad, and connected to the short bar; and a conductive impedance controller connected to the short bar, wherein said impedance controller serves as means for adjusting impedance so as to trim frequency when frequency adjustment is required after manufacturing the chip antenna.

10. The surface mounted type chip antenna as set forth in claim 9, wherein said impedance controller is connected to the short bar and formed on the third side surface of the body at a designated area.

11. The surface mounted type chip antenna as set forth in claim 9, wherein said impedance controller is connected to the short bar and extended to a designated area of the fourth side surface of the body.

12. A surface mounted type chip antenna mounted on a surface of a printed circuit board having a circuit portion, said antenna comprising:

a body including an upper surface, a lower surface, and first, second, third, and fourth side surfaces;

a conductive feeding pad including a feeding port formed on the lower surface of the body, and a feeding line formed on the first side surface of the body and connected to the feeding port;

a conductive radiation electrode formed on the upper surface of the body and electrically connected to the feeding pad;

a short bar formed on the third side surface being opposite to the first side surface and connected to the radiation electrode; and a ground electrode formed on the lower surface of the body, spaced apart from the feeding pad, and connected to the short bar, wherein said first side surface of the body provided with the feeding pad is neighbored to the second side surface adjacent to the circuit portion of the printed circuit board (PCB), and said feeding pad and said short bar are opposed to each other.

13. The surface mounted type chip antenna as set forth in claim 12, wherein said feeding line is formed on the first side surface at a designated area adjacent to the fourth side surface being opposite to the second side surface of the body; and said short bar is formed on the third side surface at a designated area adjacent to the fourth side surface being opposite to the second side surface of the body.

14. The surface mounted type chip antenna as set forth in claim 13, further comprising a conductive impedance controller connected to the short bar and serving as means for adjusting impedance so as to trim frequency when frequency adjustment is required after manufacturing the chip antenna.

15. The surface mounted type chip antenna as set forth in claim 12, wherein said feeding line is directly connected to the feeding port.

16. The surface mounted type chip antenna as set forth in claim 12, wherein the feeding port meets the feeding line at a boundary between the first side surface and the lower surface.

17. A mobile communication apparatus using a surface mounted type chip antenna, said apparatus comprising:

a printed circuit board (PCB) comprising:

a circuit portion (CP) comprising a radio frequency (RE) circuit; and an antenna portion (AP) for mounting the chip antenna, said antenna portion (AP) being connected to the circuit portion (CP); and a surface mounted type chip antenna comprising:

a body including an upper surface, a lower surface, and first, second, third, and fourth side surfaces;

a conductive feeding pad formed on the lower surface and the first side surface of the body;

a conductive radiation electrode formed on the upper surface of the body and electrically connected to the feeding pad;

a short bar formed on the third side surface being opposite to the first side surface and connected to the radiation electrode; and a ground electrode formed on the lower surface of the body, spaced apart from the feeding pad, and connected to the short bar, wherein a linear flow of current is generated by said feeding pad and said short bar, said feeding pad is formed on the first side surface at a designated area adjacent to the fourth side surface being opposite to the second side surface neighboring the circuit portion (CP) of the printed circuit board (PGB), and said short bar is formed on the third side surface at a designated area adjacent to the fourth side surface being opposite to the second side surface neighboring the circuit portion (CP) of the printed circuit board (PCB).

18. The mobile communication apparatus as set forth in claim 17, wherein said feeding pad comprises:

a feeding port formed on the lower surface of the body; and a feeding line formed on the first side surface of the body and directly connected to the feeding port.

19. The mobile communication apparatus as set forth in claim 15, wherein the feeding port meets the feeding line at a boundary between the first side surface and the lower surface.

* * * * *